US007499014B2

(12) United States Patent
Park

(10) Patent No.: US 7,499,014 B2
(45) Date of Patent: Mar. 3, 2009

(54) DRIVING CIRCUIT OF LIQUID CRYSTAL DISPLAY DEVICE FOR GENERATING RAMP SIGNAL AND METHOD FOR DRIVING LIQUID CRYSTAL DISPLAY FOR GENERATING RAMP SIGNAL

(75) Inventor: Joon Kyu Park, Kyonggi-do (KR)

(73) Assignee: LG Display Co., Ltd., Seoul (KR)

( * ) Notice: Subject to any disclaimer, the term of this patent is extended or adjusted under 35 U.S.C. 154(b) by 667 days.

(21) Appl. No.: 10/880,094

(22) Filed: Jun. 30, 2004

(65) Prior Publication Data

US 2005/0007334 A1 Jan. 13, 2005

(30) Foreign Application Priority Data

Jul. 8, 2003 (KR) ..... 10-2003-0046025

(51) Int. Cl.
*G09G 3/36* (2006.01)

(52) U.S. Cl. ..... 345/99; 345/94

(58) Field of Classification Search ..... 345/66, 345/102, 99, 94
See application file for complete search history.

(56) References Cited

U.S. PATENT DOCUMENTS

| | | | | |
|---|---|---|---|---|
| 6,137,462 | A * | 10/2000 | Kim | 345/94 |
| 6,567,062 | B1 * | 5/2003 | Kudo et al. | 345/92 |
| 6,661,402 | B1 * | 12/2003 | Nitta et al. | 345/99 |
| 7,019,728 | B2 * | 3/2006 | Lee et al. | 345/98 |
| 2002/0130830 | A1 * | 9/2002 | Park | 345/99 |
| 2002/0186183 | A1 * | 12/2002 | Akimoto | 345/55 |
| 2003/0048247 | A1 * | 3/2003 | Ham | 345/87 |

FOREIGN PATENT DOCUMENTS

| | | |
|---|---|---|
| JP | 409261319 | * 10/1997 |
| KR | 0209643 | 4/1999 |

* cited by examiner

*Primary Examiner*—Chanh Nguyen
*Assistant Examiner*—Pegeman Karimi
(74) *Attorney, Agent, or Firm*—Morgan, Lewis & Bockius LLP

(57) ABSTRACT

A driving circuit of a liquid crystal display device including: a timing controller to output control signals and video data; a ramp signal generator to receive the ramp control signal output from the timing controller, and to generate and output a ramp signal by combining a gray voltage for each level and a precharging voltage for each gray voltage; and a data driver to provide video signals to respective data lines by sampling/holding the ramp signal output from the ramp signal generator according to a value of the video data.

9 Claims, 8 Drawing Sheets

| LUT ROM Adrress (hexadecimal) | LUT Data (hexadecimal) |
|---|---|
| 00 | 350(Vp1) |
| 01 | 34B(V1) |
| 02 | 2F0(Vp2) |
| 03 | 2EA(V2) |
| 04 | 2D0(Vp3) |
| 05 | 2C1(V3) |
| 06 | 2B0(Vp4) |
| 07 | 2A5(V4) |
| ⋮ | ⋮ |
| 3C | 065(Vp31) |
| 3D | 05E(V31) |
| 3E | 032(Vp32) |
| 3F | 026(V32) |

DRIVING CIRCUIT OF LIQUID CRYSTAL DISPLAY DEVICE FOR GENERATING RAMP SIGNAL AND METHOD FOR DRIVING LIQUID CRYSTAL DISPLAY FOR GENERATING RAMP SIGNAL

This application claims the benefit of the Korean Application No. P2003-46025, filed on Jul. 8, 2003, which is hereby incorporated by reference.

BACKGROUND OF THE INVENTION

1. Field of the Invention

The present invention relates to a liquid crystal display (LCD) device, and more particularly, to a driving circuit of a liquid crystal display (LCD) device and a method for driving the same.

2. Discussion of the Related Art

Demands for various display devices have increased as the information society has developed. Accordingly, many efforts have been made to research and develop various types of flat display devices, such as liquid crystal display (LCD), plasma display panel (PDP), electroluminescent display (ELD), and vacuum fluorescent display (VFD). Some types of flat display devices have already been utilized in a variety of different applications. Among the various flat display devices, liquid crystal display (LCD) devices have been most widely used due to the advantageous characteristics of slim profile, light weight, and low power consumption. LCD devices have been provided as a substitute for a cathode ray tube (CRT) in many applications. In addition, mobile type LCD devices, such as a display for a notebook computer, have been developed. Further, LCD devices can be used as computer monitors, televisions or other types of equipment that display video.

In general, an LCD device includes an LCD panel to display video signals, and an external driving circuit to supply driving signals to the LCD panel. An LCD panel includes first and second transparent substrates (i.e., glass substrates) bonded to each other with a predetermined gap therebetween. A liquid crystal material is injected into the gap between the first and second substrates. More particularly, the first substrate includes a plurality of gate lines and data lines that cross each other defining pixel regions, pixel electrodes that are in each of the respective pixel regions, and thin film transistors that are each located at the respective crossings of the gate lines and data lines. The thin film transistors control the application of video signals from the data lines to the respective pixel electrodes in accordance with gate signals of the gate lines.

FIG. 1 is a block diagram of a related art LCD device. As shown in FIG. 1, the related art LCD device includes a data driver 11*b*, a gate driver 11*a*, a timing controller 13, a power supply part 14, a gamma reference voltage part 15, a DC/DC converter 16, a backlight 18, and an inverter 19. The data driver 11*b* inputs a data signal to each data line D of an LCD panel 11 while the gate driver 11*a* supplies a gate driving pulse to each gate line G of the LCD panel 11. The timing controller 13 receives display data R/G/B, vertical and horizontal synchronous signals Vsync and Hsync, a clock signal DCLK and a control signal DTEN from a driving system 17 of the LCD panel 11, and formats the display data, the clock signal and the control signal at a timing suitable for restoring a picture image by the gate driver 11*a* and the data driver 11*b* of the LCD panel 11. The power supply part 14 supplies a voltage to the LCD panel 11 and to the other components. The gamma reference voltage part 15 also receives power from the power supply part 14 and provides a reference voltage required when digital data inputted from the data driver 11*b* is converted to analog data. The DC/DC converter 16 outputs a constant voltage $V_{DD}$, a gate high voltage $V_{GH}$, a gate low voltage $V_{GL}$, a reference voltage $V_{ref}$, and a common voltage $V_{com}$ for the LCD panel 11 by using the voltage output from the power supply part 14. The backlight 18 provides a light source for the LCD panel 11 while the inverter 19 drives the backlight 18.

The gamma reference voltage circuit of the gamma reference voltage part 15 referred to in FIG. 1 will be described with reference to FIG. 2. FIG. 2 is a block diagram illustrating a gamma reference voltage circuit according to the related art. The gamma reference voltage circuit enhances the picture quality of the LCD device. As shown in FIG. 2, the gamma reference voltage circuit includes a power voltage $V_{dd}$ 201, a gamma register 202 dividing the power voltage $V_{dd}$ 201 to output a plurality of gamma reference voltages GMA1 to GMA10, and a gamma buffer 203 for stably amplifying and outputting the plurality of gamma reference voltages GMA1 to GMA10.

An operation of the gamma reference voltage circuit according to the related art will be described in reference to FIG. 2. As shown in FIG. 2, the gamma register 202 divides the power voltage $V_{dd}$ 201 by a plurality of resistors R1 to RIO, and outputs the plurality of gamma reference voltages GMA1 to GMA10. The outputted gamma reference voltages GMA1 to GMA10 are inputted to the gamma buffer 203, and then inputted to a plurality of amplifiers AMP1 to AMP10 of the gamma buffer 203. In the gamma buffer 203, the gamma reference voltages GMA1' to GMA10' are generated by stably amplifying and removing the noise from the gamma reference voltages GMA1 to GMA10 inputted from the amplifiers AMP1 to AMP10 of the gamma buffer 203. Subsequently, the stabilized gamma reference voltages GMA1' to GMA10' are output from the gamma buffer 203 and input to the data driver 21*b*. The data driver 21*b* outputs a liquid crystal driving voltage by changing R/G/B digital video signals to analog video signals using the gamma reference voltages GMA1' to GMA10'. The liquid crystal driving voltage is applied to the data line D of the LCD panel 21 during every scanning of the liquid crystal display panel.

The related art LCD device has some disadvantages. For example, the voltage divided by the plurality of resistors R1 to R10 also serves as a gray voltage. As the gray voltage increases, the number of the resistors from R1 to RIO needs to increases. Also, accuracy of the resistors R1 to RIO must be very precise thereby increasing the fabrication cost. To address these problems, a method has been proposed for forming a ramp signal generator outputting a ramp signal having the gray voltage of a corresponding level, and obtaining the gray voltage by sampling the ramp signal outputted from the ramp signal generator.

FIG. 3 is a waveform of a ramp signal output from a ramp signal generation circuit according to the related art. As shown in FIG. 3, the ramp signal output from the ramp signal generator is comprised of a plurality of gray voltages that are increase by steps. Accordingly, the ramp signal input to the data driver is sampled as the specific gray voltage, and then outputs a gray voltage. That is, the data driver counts the input video data according to the data size, and samples the ramp signal at a timing point that is at the completion of the count, thereby outputting the gray voltage to the video data.

The related art ramp signal generator has the following disadvantages. A ramp signal supply line provided between the ramp signal generator and the data driver, whereby the ramp signal outputted from the ramp signal generator is transmitted to the data driver. Accordingly, as resolution of the LCD panel becomes high, the length of the ramp signal supply line increases, thereby increasing the resistance and the capacitance of the ramp signal supply line. Thus, the ramp signal transmitted through the ramp signal supply line has a distorted waveform.

FIG. 4 is a waveform for explaining distortion of the ramp signal according to the related art. As shown in FIG. 3, the ramp signal generator outputs the plurality of gray voltages that increase by steps. FIG. 4 also shows the ramp signal generator output of gray voltages increasing by steps as a dotted line. However, as the ramp signal travels from the ramp signal generation circuit, the waveform of the ramp signal is distorted due to the resistance and the parasitic capacitance of the ramp signal supply line so as to arrive at the data driver having the shape shown as a solid line in FIG. 4. Accordingly, the voltages sampled by the data driver falls down Vd as compared with a desired voltage, as shown in FIG. 4. This degradation of the ramp signal degrades the picture quality of the LCD panel.

SUMMARY OF THE INVENTION

Accordingly, the present invention is directed to a driving circuit of a liquid crystal display (LCD) device and a method for driving the same that substantially obviates one or more problems due to limitations and disadvantages of the related art.

An object of the present invention is to provide a driving circuit of a liquid crystal display (LCD) device and a method for driving the same, having a ramp signal generation part outputting a ramp signal precharged by a gray voltage of a corresponding level.

Another object of the present invention is to provide a driving circuit of a liquid crystal display (LCD) device and a method for driving the same, having a ramp signal generation part to prevent occurrence of flicker during an inversion driving method Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a driving circuit of a liquid crystal display device includes: a timing controller to output control signals and video data; a ramp signal generator to receive the ramp control signal output from the timing controller, and to generate and output a ramp signal by combining a gray voltage for each level and a precharging voltage for each gray voltage; and a data driver to provide video signals to respective data lines by sampling/holding the ramp signal output from the ramp signal generator according to a value of the video data.

In another aspect, a method for driving a liquid crystal display device includes the steps of: a method for driving a liquid crystal display device comprising the steps of: storing gray voltage data for each level and precharging voltage data corresponding to the gray voltage data; sequentially outputting the gray voltage data for each level and the precharging voltage data corresponding to the gray voltage data, the precharging voltage data outputted prior to the gray voltage data; and outputting a precharged ramp signal by combining the outputted gray voltage data and the precharging voltage data.

In yet another aspect, a driving circuit of a liquid crystal display (LCD) device includes: a timing controller to output a Look-Up Table control signal; a ramp signal generator to receive the ramp control signal output from the timing controller and to generate and output a ramp signal, wherein the ramp signal generator includes a Look-Up Table to store the precharging voltage data and the gray voltage data for each level, and a logic controller to receive the Look-Up Table control signal from the timing controller and sequentially outputting data stored in the Look-Up Table; and a data driver to provide video signals to respective data lines that receives the data from the ramp signal generator.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

DETAILED DESCRIPTION OF THE PREFERRED EMBODIMENTS

Reference will now be made in detail to the preferred embodiments of the invention, examples of which are illustrated in the accompanying drawings. Wherever possible, the same reference numbers will be used throughout the drawings to refer to the same or like parts.

Figures 5, 6:
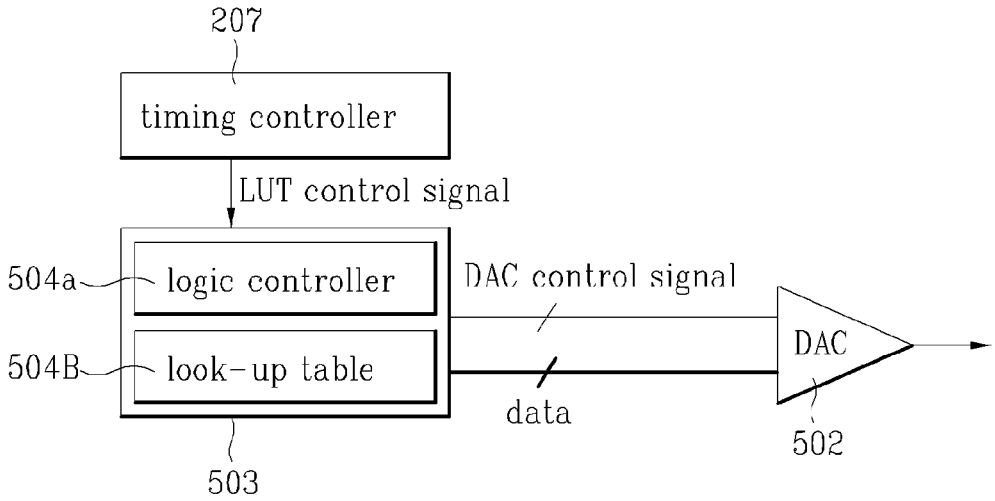
FIG. 5 is a block diagram of a ramp signal generation circuit according to an embodiment of the invention.
FIG. 6 is a data table stored in a Look-Up Table (LUT) of FIG. 5.

A driving circuit of an LCD device having a ramp signal generation part according to an embodiment of the invention and a method for driving the same will be described with reference to the accompanying drawings. FIG. 5 is a block diagram of a ramp signal generation circuit according to an embodiment of the invention. As shown in FIG. 5, the ramp signal generation circuit according to the embodiment of the invention includes a signal generator 503 and a digital/analog converter 502. The signal generator 503 includes a look-up table 504*b* for storing the precharging voltage data and the gray voltage data for each level, and a logic controller 504*a* for receiving the LUT (look up table) control signal from the timing controller 207 and sequentially outputting the data stored in the look-up table 504*b*.

The operation of ramp signal generation circuit begins with Look-Up Table control signal being applied to the signal generator 503 from the timing controller 207. After the signal generator 503 receives a look-up table control signal (hereinafter, referred to as an 'LUT control signal'), the signal generator 503 outputs a digital/analog converter control signal (hereinafter, referred to as a 'DAC control signal'), precharging voltage data and gray voltage data for each level. The outputs of the signal generator 503 are applied to a digital/analog converter 502. The precharging voltage data and the gray voltage data for each level are converted to analog signals by the digital/analog converter 502 according to the DAC control signal output from the signal generator 503. The analog signals are output from the digital/analog converter 502 as a precharged ramp signal.

FIG. 6 is a data table stored in the look-up table (LUT) of FIG. 5. Referring to FIG. 6, the gray voltage data (V1, V2, . . . , V32) for each level and the precharging voltage data (Vp1, Vp2, . . . , Vp32) are sequentially and alternately stored in the address (00, 01, 02, 03, . . . , 3F) of the Look-Up Table. To precharge the gray voltage for each level prior to the gray voltage data for each level, the precharging voltage data is stored in the previous address.

Figure 7:
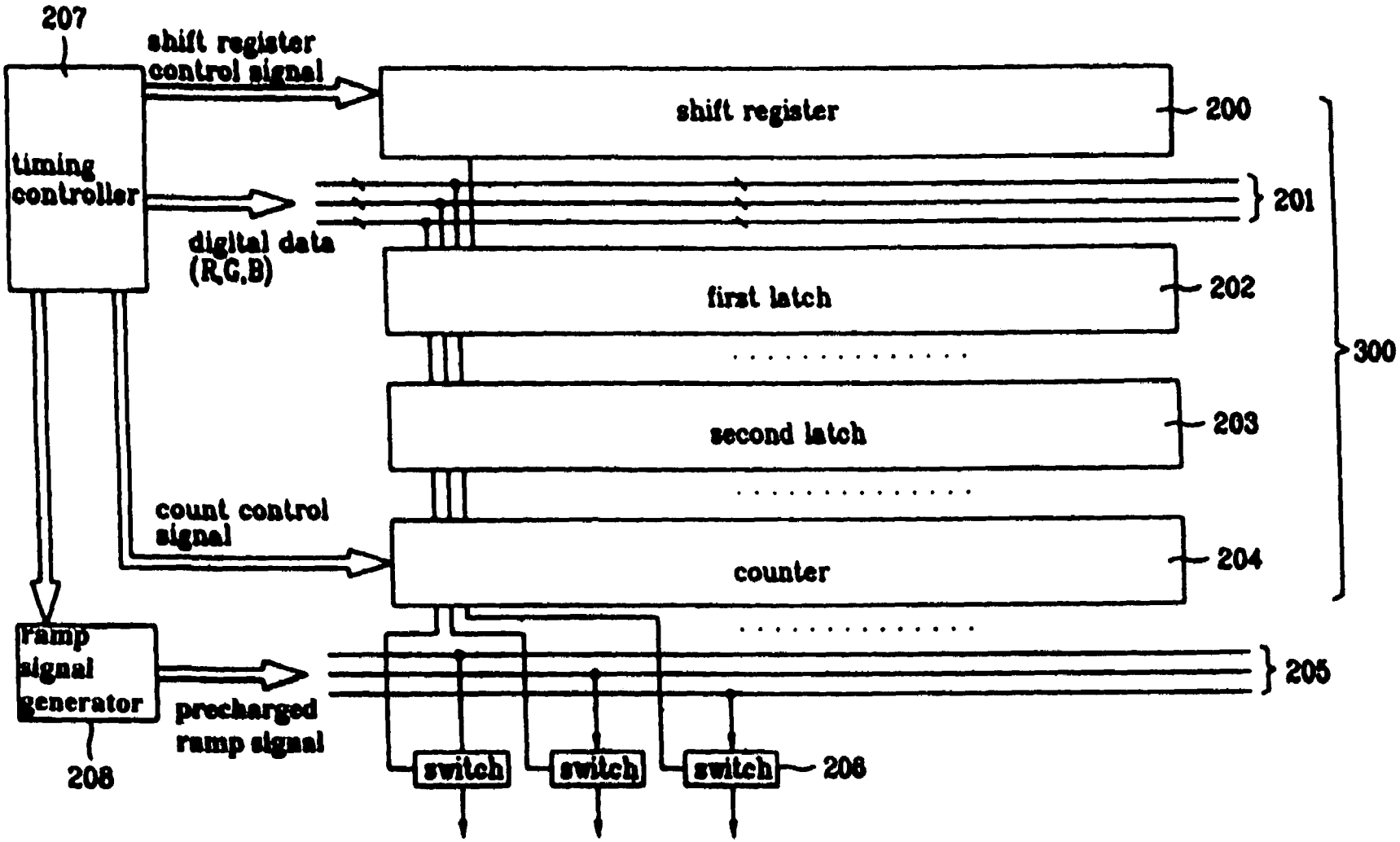
FIG. 7 is a block diagram of a driving circuit of an LCD device having a ramp signal generation part according to an embodiment of the invention.

FIG. 7 is a block diagram of the driving circuit of the LCD device having a ramp signal generation part according to the preferred embodiment of the present invention. As shown in FIG. 7, the driving circuit of the LCD according to the preferred embodiment of the present invention includes a timing controller 207, a ramp signal generator 208, and a data driver 300. The timing controller 207 provides a shift register control signal (hereinafter, referred to as an 'SR control signal'), video data, a count control signal, and a ramp control signal. The ramp signal generator 208 receives the ramp control signal output from the timing controller 207, and outputs a precharged ramp signal. The data driver 300 also provides video signals to respective data lines by inputting the SR control signal, digital data and the count control signal output from the timing controller 207, and the precharged ramp signal outputted from the ramp signal generator 208, and sampling/holding the ramp signal output from the ramp signal generator 208 according to a value of the video data.

The data driver 300 includes a shift register 200, a first latch 202, a second latch 203, a counter 204, and a sampler/holder 206. At this time, the shift register 200 receives the SR control signal outputted from the timing controller 207, and outputs a shift signal. The first latch 202 sequentially latches and outputs digital video data R/G/B outputted from the timing controller 207 according to the shift signal outputted from the shift register 200. The second latch 203 latches the video data outputted from the first latch 202 for each line, and outputs the video data latched for each line. The counter 204 receives the video data outputted from the second latch 203, and the count control signal outputted from the timing controller 207, and then outputs a pulse width modulation signal having a pulse width corresponding to the value of the video data by counting the value of the sampled video data. A sampler/holder 206 receives the pulse width modulation signal outputted from the counter 204 and the precharged ramp signal output from the ramp signal generator 208, and outputs the gray voltage by sampling/holding the precharged ramp signal with the pulse width modulation signal. Herein, unexplained reference 205 designates a ramp signal supply line for transmitting the precharged ramp signal. The ramp signal generator 208 has the structure of FIG. 5.

Figure 8:
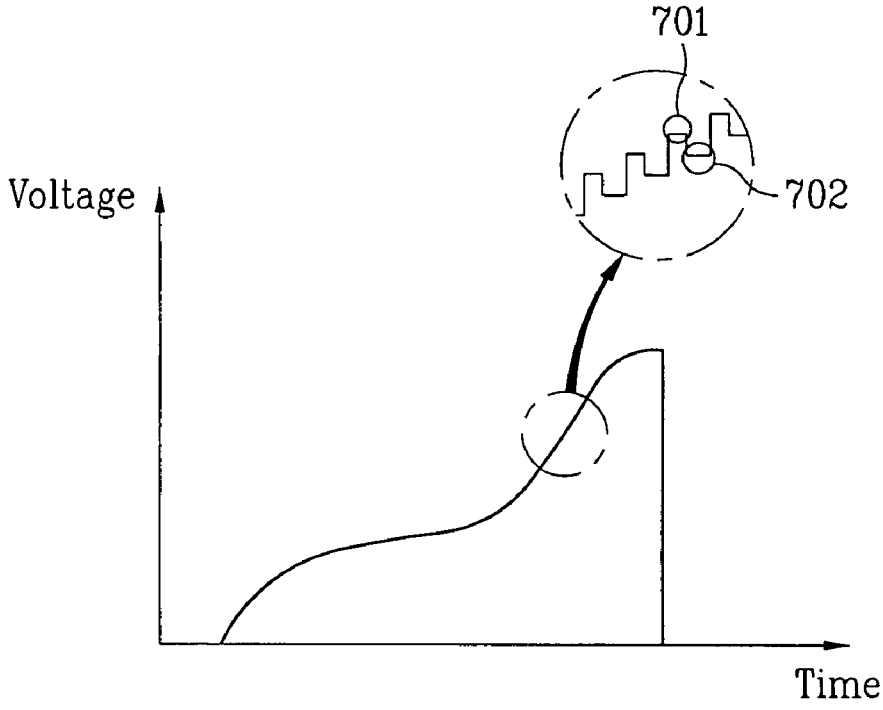
FIG. 8 is a waveform of a precharging ramp signal outputted from a ramp signal generation circuit according to an embodiment of the invention.
Figure 9:
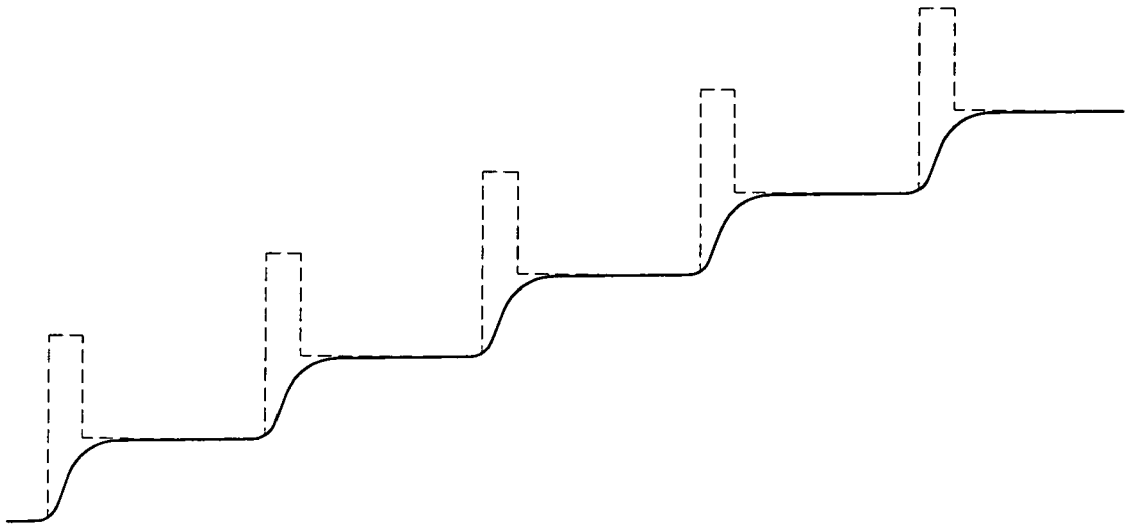
FIG. 9 is a waveform of a ramp signal according to the present invention by resistance of a ramp signal supply line and parasitic capacitance.
Figure 10A:
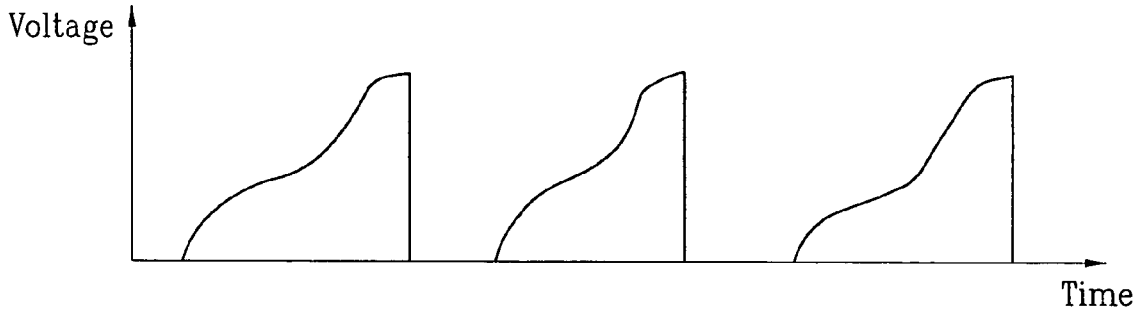
FIG. 10A is a graph illustrating a waveform of a precharged ramp signal.
Figure 10B:
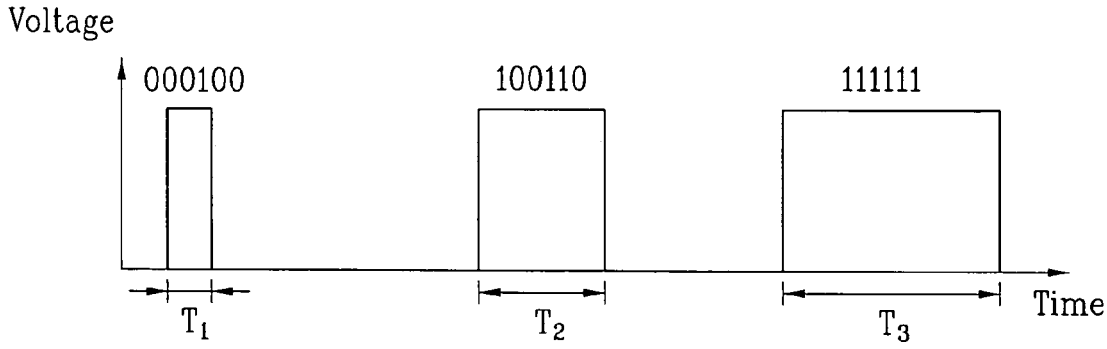
FIG. 10B is a graph illustrating a waveform of a pulse width modulation signal.
Figure 10C:
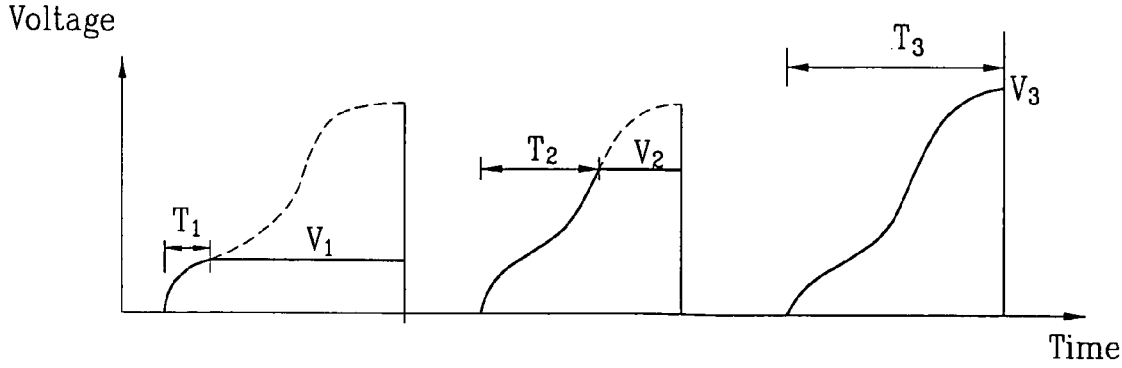
FIG. 10C is a graph illustrating a waveform of a gray voltage.

A method for driving the LCD device having the aforementioned ramp signal generator according to the embodiment of the invention will be described in detail. FIG. 8 is a waveform of a precharged ramp signal output from a ramp signal generator according to the present invention. FIG. 9 is a waveform of a ramp signal according to resistance and parasitic capacitance on a ramp signal supply line. FIG. 10A is a graph illustrating a waveform of a precharged ramp signal. FIG. 10B is a graph illustrating a waveform of a pulse width modulation signal. FIG. 10C is a graph illustrating a waveform of a gray voltage.

Figure 1:
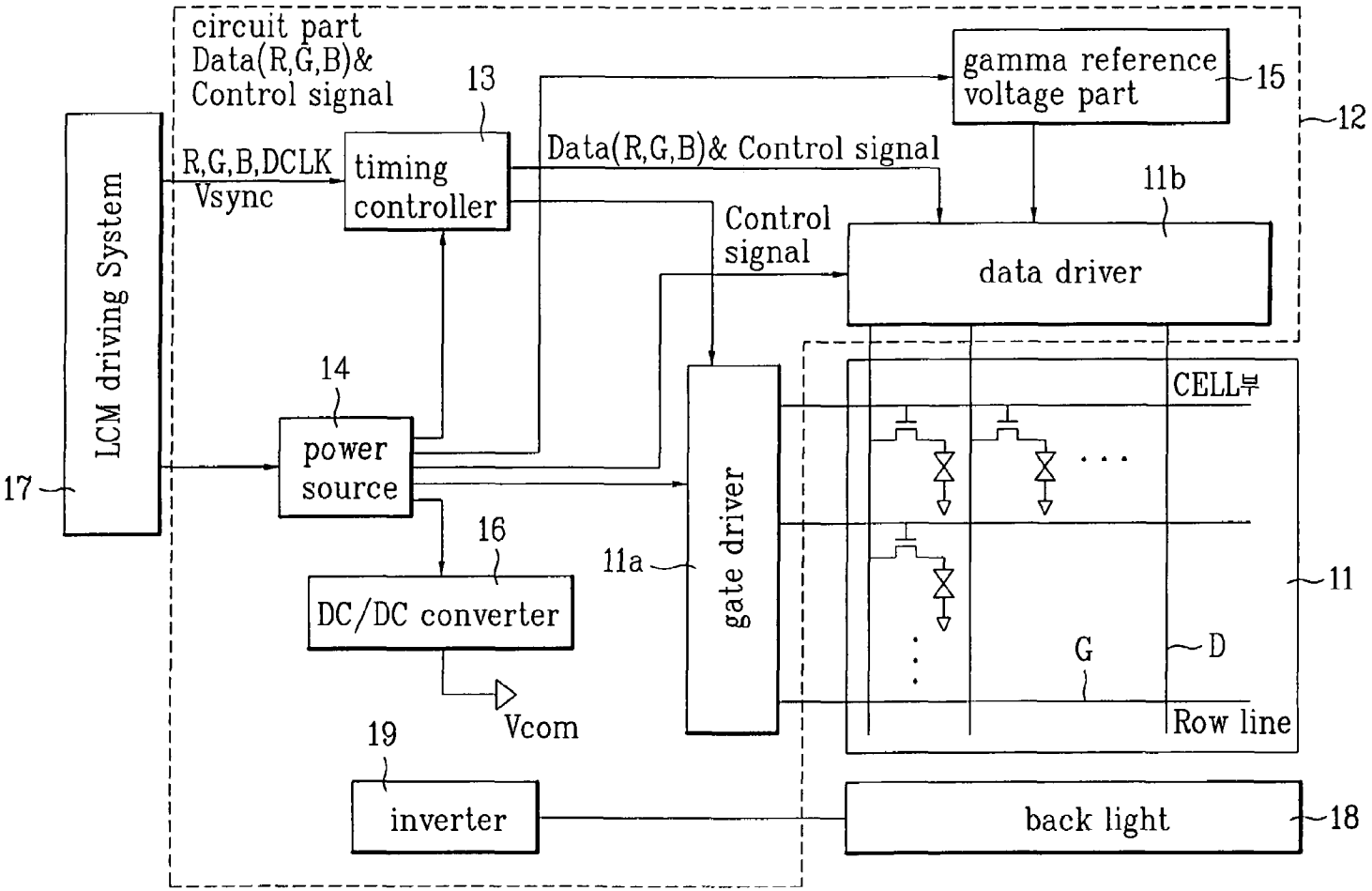
FIG. 1 Related Art
FIG. 1 is a block diagram of an LCD device according to the related art.
Figure 2:
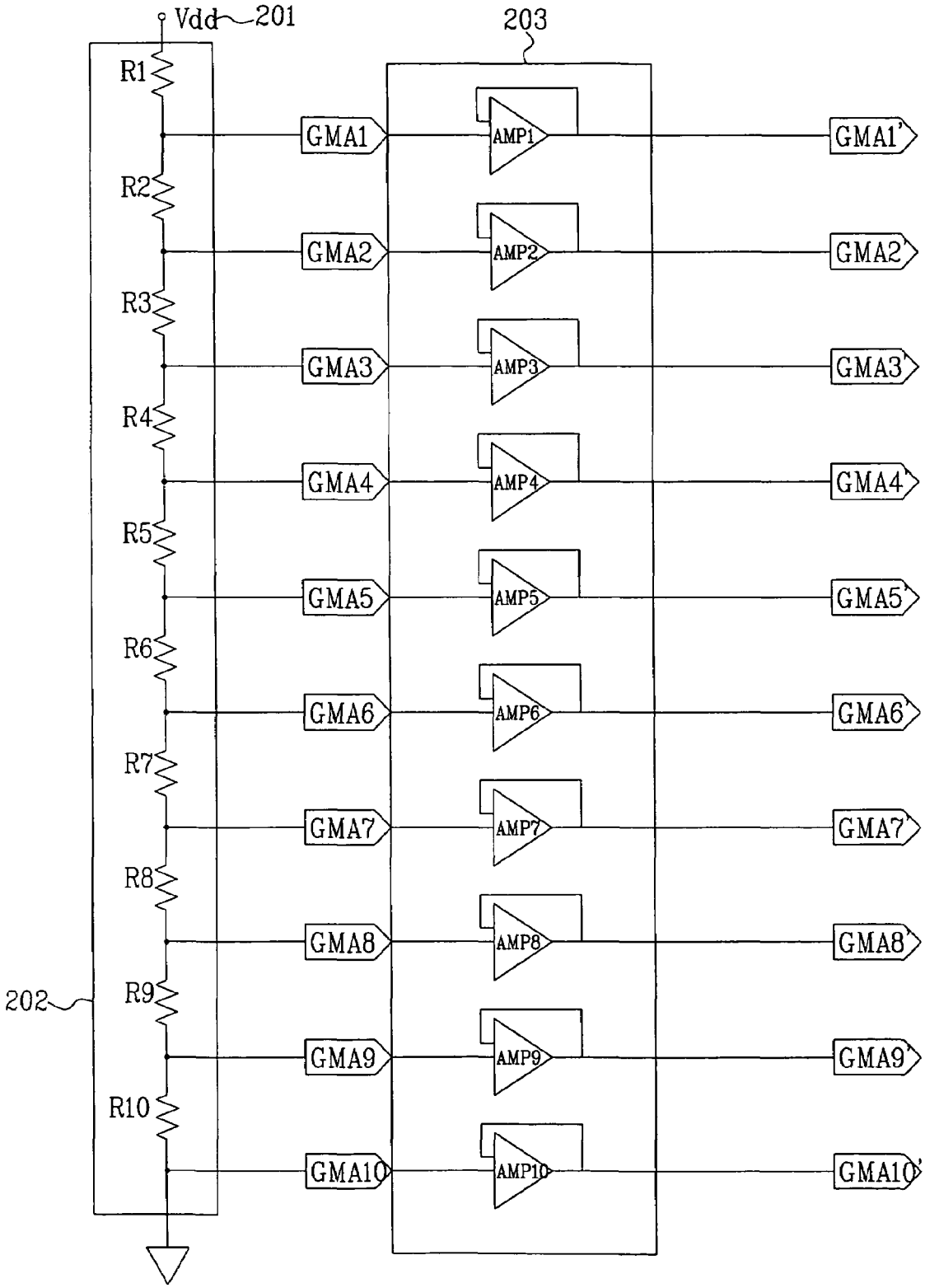
FIG. 2 Related Art
FIG. 2 is a block diagram of a gamma reference voltage circuit according to the related art.
Figure 3:
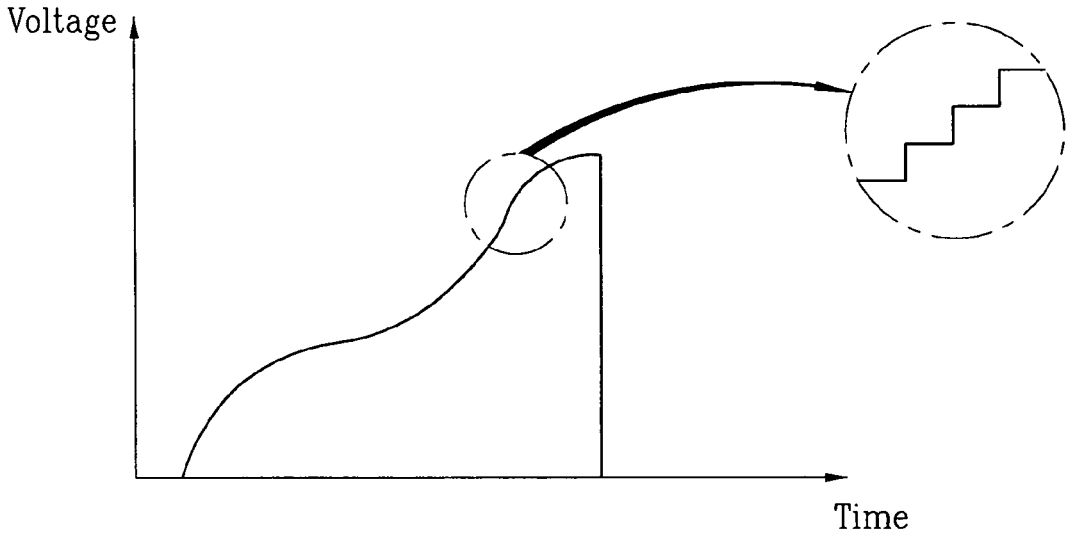
FIG. 3 Related Art
FIG. 3 is a waveform of a ramp signal outputted from a ramp signal generation circuit according to the related art.

First, when the LUT control signal is output from the timing controller 207, and input to the signal generator 503, the logic controller 504*a* of the signal generator 503 reads the Look-Up Table 504*b*, and sequentially outputs the data previously stored in each from the first address 00 to the final address 3F while simultaneously outputting the DAC control signal. More specifically, the data previously stored relates to the gray voltage for each level, and the precharging voltage for each gray voltage. The data is outputted in the sequential order of the address, so that the precharging voltage is outputted prior to each gray voltage. After that, a series of output data (the gray voltage and the precharging voltage) are sequentially input to the digital/analog converter 502. Then, the digital/analog converter 502 latches the data (the gray voltage and the precharging voltage), and outputs the data (the gray voltage and the precharging voltage) in synchronization with the DAC control signal. Thus, as shown in FIG. 8, the ramp signal precharged for each level is output. That is, as shown in FIG. 8, the precharged ramp signal includes the gray voltage 702 of the corresponding level and the precharging voltage 701 having 2 to 3 higher gray levels than that of the gray voltage. At this time, the ramp signal of FIG. 3 is a positive polarity signal. Also, a ramp signal of a negative polarity, being in symmetryc with respect to a Time-axis, has the gray voltage 702 and the precharging voltage 701.

In the preferred embodiments of the invention, the ramp signal uses the monotone increasing or decreasing voltage waveform according to time. However, the ramp signal of the embodiments of the invention are not limited to this. In case the transmittance characteristics are shown according to an apply voltage for liquid crystal, it is possible to use the curved-line or the staircase waveform.

The precharged ramp signal outputted from the ramp signal generator 208 is applied to the data driver of the LCD device through the ramp signal supply line 205 and the sampler/holder 206, whereby the data driver outputs the stable gray voltage. The internal resistance and the parasitic capacitance of the ramp signal supply line 205 are taken into consideration, as shown in FIG. 9, such that the ramp signal output through the ramp signal supply line 205 by the precharging voltage, adjacent to the gray voltage for each level, is applied to the sampler/holder 206. Accordingly, it is possible to provide a stable ramp signal despite the internal resistance and the parasitic capacitance of the ramp signal supply line.

After that, the first latch 202 samples and outputs the video data of the timing controller 207 transmitted through a data supply line 201 according to the shift signal outputted from the shift register 200. Then, the second latch 203 sequentially receives the sampled video data outputted from the first latch 202, and outputs the video data for one line to the counter 204. The counter 204 receives the video data from the second latch, and then outputs the pulse width modulation signal having the different pulse widths according to the value of the video data. That is, according as the video data is inputted, the counter 204 counts the amount of the video data according to the count control signal inputted from the timing controller 207, thereby outputting the pulse width modulation signal corresponding to the amount of the video data. Then, the sampler/holder 206 receives the pulse width modulation signal output from the counter 204, and the precharged ramp signal (FIG. 10A) output from the ramp signal generator 208 through the ramp signal supply line 205, and samples and holds the precharged ramp signal according to the pulse width modulation signal, thereby outputting the gray voltage corresponding to the pulse width modulation signal.

Figure 4:
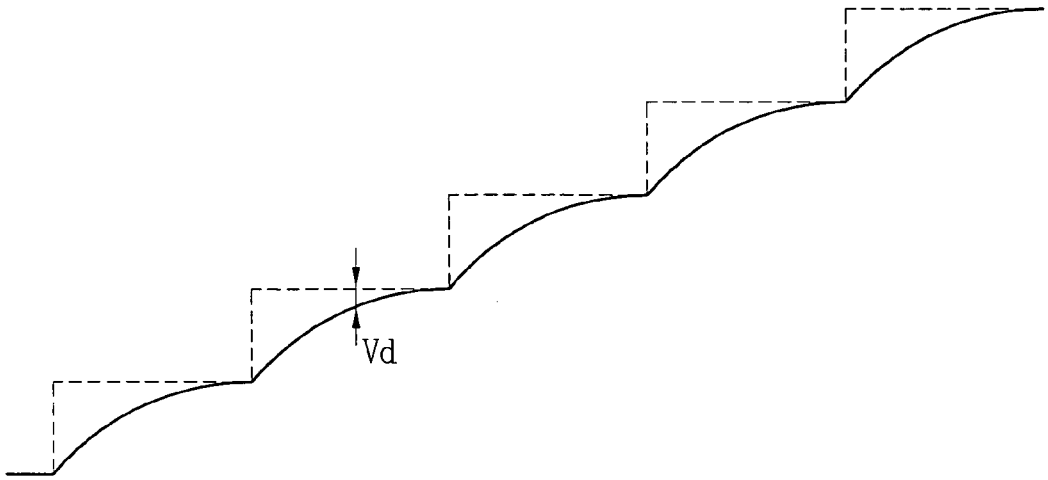
FIG. 4 Related Art
FIG. 4 is a waveform for explaining distortion of a ramp signal according to the related art.

For example, as shown in FIG. 10B, if the sampled video data of 6 bits, such as '000100', '100110' or '111111', is inputted, the counter 204 counts the amount of the sampled video data, and outputs the pulse width modulation signal maintaining the pulse width of the high state during a period (T1, T2 or T3) counting the sampled video data. Accordingly, as shown in FIG. 10C, during the high state pulse width period (T1, T2 or T3) of the pulse width modulation signal outputted form the counter 204, the sampler/holder 206 samples and holds the precharged ramp signal shown in FIG. 10A, thereby outputting the gray voltage (V1, V2 or V3). When the pulse width modulation signal outputted form the counter 204 is in the high stage, the sampler/holder 206 comprising of a transistor for switching is turned-on, whereby the data line is charged with the precharged ramp signal during the high state of the pulse width modulation signal. Then, by sampling and holding the ramp signal (FIG. 3 or FIG. 4A) at a turning-off point for changing the pulse width modulation signal to a low state, the data line is maintained as the gray voltage (V1, V2 or V3) of the turning-off point.

As shown in FIG. 8, each precharging voltage 701 of the precharged ramp signal is processed prior to the corresponding gray voltage 702, and the sampling point is processed in the section for the gray voltage 702 of the precharged ramp signal. Thus, even though there is the difference of capacitance and resistance between the front and rear ends of the ramp signal supply line 205, the gray voltage 702 is compensated as shown in FIG. 9. That is, even in case the capacitance and resistance increases by the inevitable increase of the length of the ramp signal supply line 205 according as the size of the LCD device increases, it is possible to prevent the distortion of the ramp signal. Also, the gray voltage obtained by sampling the precharged ramp signal is outputted stably. Furthermore, it is possible to prevent occurrence of flicker by using the precharged ramp signal.

Generally, the LCD device is driven in an inversion method by alternately applying positive and negative polarities of the gray voltage to each frame, thereby preventing deterioration of the liquid crystal in each pixel. That is, the positive polarity gray voltage (+) and the negative polarity gray voltage (−) are alternately applied to the respective pixels in every frame, wherein the positive polarity gray voltage is obtained by sampling the positive polarity ramp signal, and the negative polarity gray voltage is obtained by sampling the negative polarity ramp signal.

The inversion method is classified into a line inversion method, a column inversion method, and a dot inversion method. In the line inversion method, the positive and negative (+) and (−) polarity gray voltages are alternately applied to gate lines, whereby the polarity of effective voltage applied to the liquid crystal corresponding to the odd numbered gate lines is in opposite to that corresponding to the even numbered gate lines. In case of the column inversion, the positive and negative (+) and (−) polarity gray voltages are alternately applied to data lines, whereby the voltage polarity of the odd numbered data lines is in opposite to that of the even numbered data lines. Also, the dot inversion method is the driving method combining the line inversion method and the column inversion method, whereby the polarity of effective voltage is differently applied to the pixels adjacent in horizontal and vertical directions. In the meantime, the inversion driving method generates a feed-through voltage, the feed-through voltage lowering the effective voltage of the pixel when applying the positive (+) polarity gray voltage, and heightening the effective voltage of the pixel when applying the negative (−) polarity gray voltage, thereby generating the difference of absolute values between the positive (+) and negative (−) polarity gray voltages. As a result, luminance difference generates due to the difference of absolute values between the positive (+) and negative (−) polarity gray voltages, thereby causing occurrence of flicker on a screen. However, in the case of the present invention, the data driver receiving the precharged ramp signal can output a gray voltage stably, thereby preventing the occurrence of flicker by minimizing the difference of the effective voltages applied to the pixels.

As mentioned above, the driving circuit of the LCD device according to the embodiments of the invention and the method for driving the same have the following advantages. In the driving circuit of the LCD device according to the embodiments of the invention, the ramp signal generator provides the precharged ramp signal, whereby it is possible to prevent the distortion of the ramp signal generated by the resistance and the capacitance of the ramp signal supply line. Also, it is possible to decrease the difference of the effective voltages by the feed-through voltage when using the inversion driving method, thereby preventing the occurrence of flicker.

It will be apparent to those skilled in the art that various modifications and variations can be made in the embodiments of the invention. Thus, it is intended that the embodiments of the invention cover the modifications and variations of this invention provided they come within the scope of the appended claims and their equivalents.

What is claimed is:

1. A driving circuit of a liquid crystal display device for generating ramp signal comprising:

a timing controller to output control signals and video data;

a ramp signal generator to receive a ramp control signal output from the timing controller, and to generate and output a ramp signal by combining a gray voltage for each level and a precharging voltage for each gray voltage, wherein the precharging voltage data is at least two gray levels higher than that of the gray voltage; and a data driver to provide video signals to respective data lines by sampling/holding the ramp signal output from the ramp signal generator according to a value of the video data;

wherein the ramp signal generator includes: a signal generator to receive a look-up table control signal (LUT control signal) from the timing controller, and to output a digital/analog converter control signal (DAC control signal), precharging voltage data and gray voltage data for each level; and a digital/analog converter to output a precharged ramp signal by converting the precharging voltage data and the gray voltage data for each level to analog signals according to the DAC control signal outputted from the signal generator; and wherein the signal generator includes: a look-up table having the precharging voltage data and the gray voltage data for each level; and a logic controller to receive the LUT control signal from the timing controller and to sequentially output the combined precharging voltage data and the data in the look-up table.

2. The driving circuit of claim 1, wherein the gray voltage data for each level and the precharging voltage data for precharging the gray voltage data are sequentially and alternately stored in the addresses of the look-up table, and the precharging voltage data is stored in the address prior to the gray voltage data for the corresponding level.

3. The driving circuit of claim 1, wherein the data driver comprises:

a shift register to receive a shift register control signal output from the timing controller, and to output a shift signal;

a first latch to sequentially latch and output digital video data R/G/B output from the timing controller according to the shift signal outputted from the shift register;

a second latch to latch the video data outputted from the first latch for each line, and to output the video data latched for each line;

a counter to receive the video data output from the second latch, and to count the control signal output from the timing controller, and to output a pulse width modulation signal having a pulse width corresponding to the value of the video data by counting the value of the video data; and a sampler/holder to receive the pulse width modulation signal outputted from the counter and the precharged ramp signal outputted from the ramp signal generator, and to output the gray voltage by sampling/holding the precharged ramp signal with the pulse width modulation signal.

4. A method for driving a liquid crystal display device for generating ramp signal comprising:

storing gray voltage data for each level and precharging voltage data corresponding to the gray voltage data, wherein the precharging voltage data is at least two gray levels higher than that of the gray voltage;

sequentially outputting the gray voltage data for each level and the precharging voltage data corresponding to the gray voltage data, the precharging voltage data outputted prior to the gray voltage data; and outputting a precharged ramp signal by combining the outputted gray voltage data and the precharging voltage data;

wherein the step of sequentially outputting the gray voltage data includes; receiving a look-up table control signal (LUT control signal) from a timing controller; and outputting a digital/analog converter control signal (DAC control signal), precharging voltage data and gray voltage data for each level; and outputting a precharged ramp signal by converting the precharging voltage data and the gray voltage data for each level to analog signals according to the DAC control signal; and wherein the precharging voltage data and the gray voltage data for each level is stored in a look-up table;

wherein the step of receiving a look-up table control signal (LUT control signal) from a timing controller, and outputting a digital/analog converter control signal (DAC control signal), precharging voltage data and gray voltage data for each level includes; receiving the LUT control signal from the timing controller and sequentially outputting the combined precharging voltage data and the data in the look-up table.

5. The method of claim 4, further comprising: counting a value of inputted video data;

generating a pulse width modulation signal having a pulse width corresponding to the counted value of the inputted video data; and applying video signals to respective data lines by sampling/holding the precharged ramp signal according to the pulse width modulation signal.

6. A driving circuit of a liquid crystal display device for generating ramp signal comprising:

a timing controller to output a look-up table control signal and a ramp control signal;

a ramp signal generator to receive the ramp control signal output from the timing controller and to generate and output a ramp signal by combining the precharging voltage data and the gray scale voltage data, wherein the ramp signal generator includes a look-up table to store the precharging voltage data and the gray voltage data for each level, and a logic controller to receive the look-up table control signal from the timing controller and sequentially outputting combined the precharging voltage data and the gray scale voltage data stored in the look-up table; and a data driver to provide video signals to respective data lines that receives the data from the ramp signal generator.

7. The driving circuit of claim 6, wherein the gray voltage data for each level and the precharging voltage data for precharging the gray voltage data are sequentially and alternately stored in the addresses of the look-up table, and the precharging voltage data is stored in the address prior to the gray voltage data for the corresponding level.

8. The driving circuit of claim 6, wherein the precharging voltage data is at least two gray levels higher than that of the gray voltage.

9. The driving circuit of claim 6, wherein the data driver comprises:

a shift register to receive a shift register control signal output from the timing controller, and to output a shift signal;

a first latch to sequentially latch and output digital video data R/G/B output from the timing controller according to the shift signal outputted from the shift register;

a second latch to latch the video data outputted from the first latch for each line, and to output the video data latched for each line;

a counter to receive the video data output from the second latch, and to count the control signal output from the timing controller, and to output a pulse width modulation signal having a pulse width corresponding to the value of the video data by counting the value of the video data; and a sampler/holder to receive the pulse width modulation signal outputted from the counter and the precharged ramp signal outputted from the ramp signal generator, and to output the gray voltage by sampling/holding the precharged ramp signal with the pulse width modulation signal.

* * * * *